US006758373B2

(12) United States Patent
Jackson et al.

(10) Patent No.: US 6,758,373 B2
(45) **Date of Patent: *Jul. 6, 2004**

(54) AEROSOL VALVE ACTUATOR

(75) Inventors: Nigel L. Jackson, Peterborough (GB); Guenter Kolanus, Niedernhausen (DE)

(73) Assignee: Precision Valve Corporation, Yonkers, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 31 days.

(21) Appl. No.: 10/144,370

(22) Filed: May 13, 2002

(65) Prior Publication Data

US 2003/0209569 A1 Nov. 13, 2003

(51) Int. Cl.[7] ..... B65D 83/00
(52) U.S. Cl. ..... 222/153.11; 222/402.11
(58) Field of Search ..... 222/153.11, 402.11, 222/402.13

(56) References Cited

U.S. PATENT DOCUMENTS

| | | | | |
|---|---|---|---|---|
| 3,185,350 A | | 5/1965 | Abolanalp et al. | |
| 3,744,682 A | | 7/1973 | Blank | |
| 3,754,689 A | | 8/1973 | Blank | |
| 3,884,393 A | * | 5/1975 | Wassilieff | 222/153.02 |
| 5,027,982 A | * | 7/1991 | Demarest | 222/182 |
| 5,158,206 A | | 10/1992 | Kobayashi | |
| 5,242,087 A | * | 9/1993 | Keldenich et al. | 222/153.11 |
| 6,126,044 A | | 10/2000 | Smith | |
| 6,302,302 B1 | * | 10/2001 | Albisetti | 222/153.11 |
| 6,523,722 B1 | * | 2/2003 | Clark et al. | 222/153.14 |

FOREIGN PATENT DOCUMENTS

| | | |
|---|---|---|
| EP | 0 119 084 | 9/1984 |

* cited by examiner

*Primary Examiner*—Joseph A. Kaufman
(74) *Attorney, Agent, or Firm*—Kilgannon & Steidl

(57) ABSTRACT

A camless aerosol valve actuator with a top portion mounted on and rotatable with respect to a bottom portion from an inoperative to an operative position. A first collar of the top portion has a side opening and a first central opening with a depressible finger pad mounted therein. A second collar of the bottom portion has a depressible product channel member with a nozzle positioned adjacent the second collar. A finger pad first protuberance overlies and aligns with the product channel member only in the operative actuator position. The nozzle aligns with the first collar side opening only in the operative actuator position, and the nozzle is blocked by the first collar in the inoperative position. A finger pad second protuberance braces the product channel member in the operative actuator position. The finger pad can be depressed downwardly in both the operative and inoperative positions, with the first protuberance moving below and bypassing the product channel member in the actuator inoperative rotated position. A support on the second collar connects to the product channel member by a frangible tag, and said support also provides a lower limit stop for the finger pad in both the operative and inoperative actuator positions. The finger pad first protuberance has a knife-edge which cooperates with an off-center groove in the product channel member in the operative position.

12 Claims, 5 Drawing Sheets

AEROSOL VALVE ACTUATOR

FIELD OF THE INVENTION

The present invention relates to aerosol valve actuators of the type often referred to as spray dome actuators. More particularly, the present invention relates to such an actuator having a top portion mounted on and rotatable with respect to a bottom portion between a first operative rotated position for valve actuation and a second inoperative rotated position in which the valve cannot be actuated.

BACKGROUND OF THE INVENTION

In prior art aerosol valve actuators of the nature referred to above, cam and cam follower mechanisms are often utilized to allow the actuator to operate the aerosol valve in one rotated position and block any operation of the aerosol valve in the second rotated position. Such designs require the presence of additional molded structure, and may confuse the ultimate user in that the finger pad operating the actuator will not depress except when the actuator is in the operative rotated position. The user of such a design accordingly may force the cam mechanism into a damaged or broken condition when trying to depress the finger pad while the actuator is in the inoperative rotated position. In other prior art designs where cam mechanisms may not be present, there still may be obstructing means preventing finger pad depression when the actuator is in the inoperative rotated position. Still further, in certain other prior art designs, the actuator nozzle remains uncovered in the inoperative rotated position of the actuator to potentially further confuse the user. Examples of one or more of the above aspects of prior designs are found in U.S. Pat. No. 5,158,206 and European Patent Application No. 98 966 319.0.

SUMMARY OF THE INVENTION

The present invention is intended to provide an aerosol actuator which is strongly constructed, easily manufactured and assembled, functions reliably and efficiently, and presents less opportunity for damage or confusion in use by the customer. In particular, the actuator is characterized by the absence of a cam and cam follower or other means to prevent finger pad depression in the inoperative rotated position. Further, the actuator nozzle is only uncovered in the operative rotated position.

The aerosol actuator of the present invention has a top portion mounted on and rotatable in relation to the bottom portion between a first operative rotated position for valve actuation and a second inoperative rotated position at which the valve cannot be actuated. The top portion has a first collar with a first central opening into which extends a finger pad mounted by a living hinge to the collar. The collar has an opening through its side for dispensing of product. The actuator bottom portion has a second collar with a second central opening. A product channel member in the actuator bottom portion is pivotally mounted on the second collar with a product dispensing nozzle adjacent the second collar, the product channel member extending across at least a part of the second central opening and having means for connection to the aerosol valve stem extending upwardly from the aerosol container.

The nozzle in the actuator bottom portion extends upwardly from the second collar and is aligned with the side opening in the first collar of the actuator upper portion only when the actuator is in the first operative position, the nozzle being covered by the first collar side wall at the inoperative rotated position of the actuator. At such inoperative position, only a blank wall is viewed through the opening in the side wall of the first collar, and a user will thus easily observe that the actuator is not in the operative rotated position for actuating.

Further, in either the operative rotated position or the inoperative rotated position of the actuator, the finger pad can be fully depressed by the user. In the operative rotated position, a protuberance on the underside of the finger pad aligns with the top surface of a rearward extension of the product channel member to actuate the aerosol valve upon depressing the finger pad. In the inoperative position of the actuator, when the finger pad is depressed by the user, the protuberance moves downwardly below and bypasses the product channel member so as not to actuate the aerosol valve.

Other advantageous features of the present invention include the second collar on the actuator bottom portion having a first upstanding support connected to the product channel member by a first frangible tag which ruptures upon first actuation of the aerosol valve. Due to the first frangible tag, the product channel member will not be displaced upwardly when the aerosol actuator is first mounted on the aerosol valve stem. Likewise, the finger pad may have a corresponding frangible tag connected to the first collar to prevent depression of the finger pad when the actuator is shrink-wrapped for shipping. This latter tag is broken on first actuation of the finger pad. The aforementioned first upstanding support further provides a lower limit stop for the finger pad, when depressed either in the operative rotated position or the inoperative rotated position of the actuator.

The second collar of the present invention may have an outer skirt and an inner skirt, wherein the inner skirt contains ledge means for snapping the second collar onto an aerosol valve mounting cup. The top and bottom portions of the actuator further have snap means to assemble the top portion onto the bottom portion. Additionally, the top and bottom portions have stop means to define both the operative and inoperative rotated positions of the actuator. Still further, the finger pad may also have a second depending protuberance which braces against the side of the product channel member when the top portion is in the operative rotated position. The product channel member also may have an off-center groove in its top surface, and the finger pad first protuberance may have a knife-like edge fitting into the groove when the finger pad is pressed downwardly while the top portion is in the first operative rotated position.

Other features and advantages of the present invention will be apparent from the following description, drawings and claims.

DETAILED DESCRIPTION OF EMBODIMENT

Figure 1:
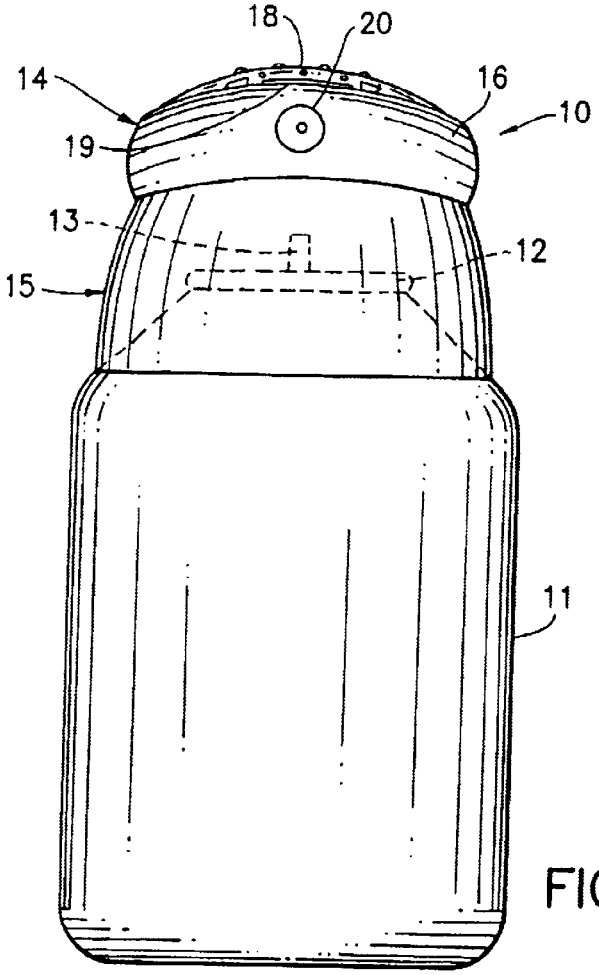
FIG. 1 is a front elevational view of the assembled aerosol valve actuator of the present invention mounted on an aerosol container.

Referring to FIG. 1, camless aerosol valve actuator 10 of the present invention is shown mounted on an aerosol container 11 which may contain a variety of products, for example an anti-perspirant. An aerosol valve is located in known fashion at the top of the container in a mounting cup 12 attached to container 11, with aerosol valve stem 13 extending upwardly, as shown in dotted line form in FIG. 1. Aerosol valve actuator 10 comprises a top plastic portion 14 assembled to a bottom plastic portion 15 which in turn is mounted onto the aerosol valve container in a manner hereinafter described.

Figure 2:
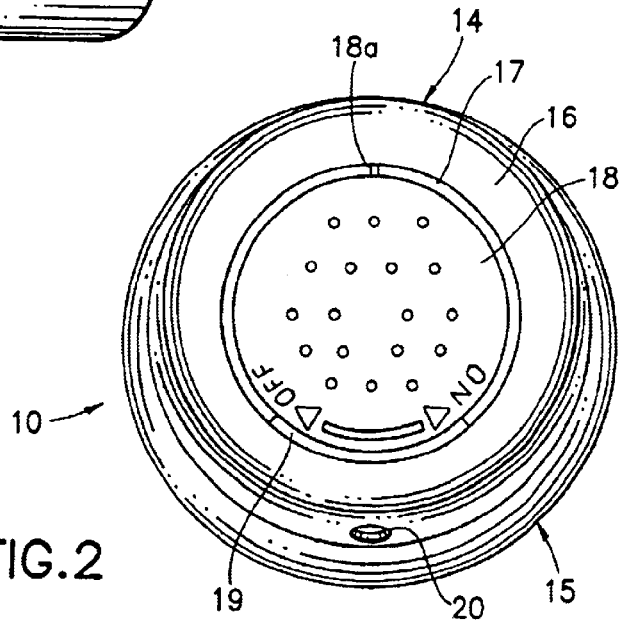
FIG. 2 is a top plan view of the assembled aerosol valve actuator of the present invention.

Referring to FIGS. 1 and 2, molded top portion 14 comprises a first collar 16 which defines a first central opening 17 into which extends finger pad 18 mounted to collar 16 by a living hinge 19. Finger pad 18 thus may be depressed downwardly by a user's finger, and will return back to its upward position upon release. Annular collar 16 includes a lateral opening 20 extending through its side wall for product dispensing.

Figure 3:
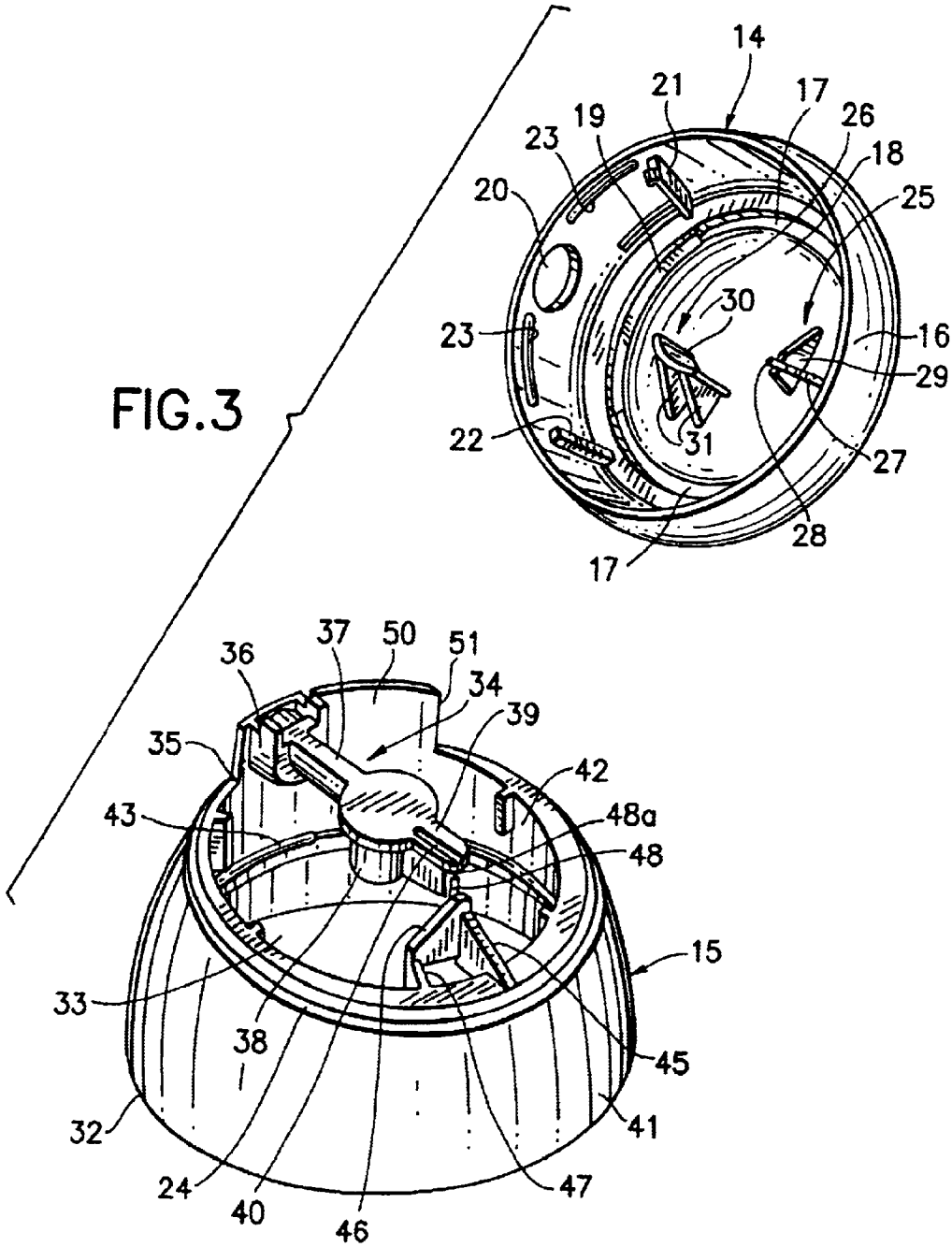
FIG. 3 is a perspective view of the top and bottom portions of the aerosol valve actuator of the present invention, said top and bottom portions being disassembled and oriented with respect to each other at an angle of approximately ninety degrees to illustrate the upper part of said bottom portion, and the lower part of said top portion.
Figure 4:
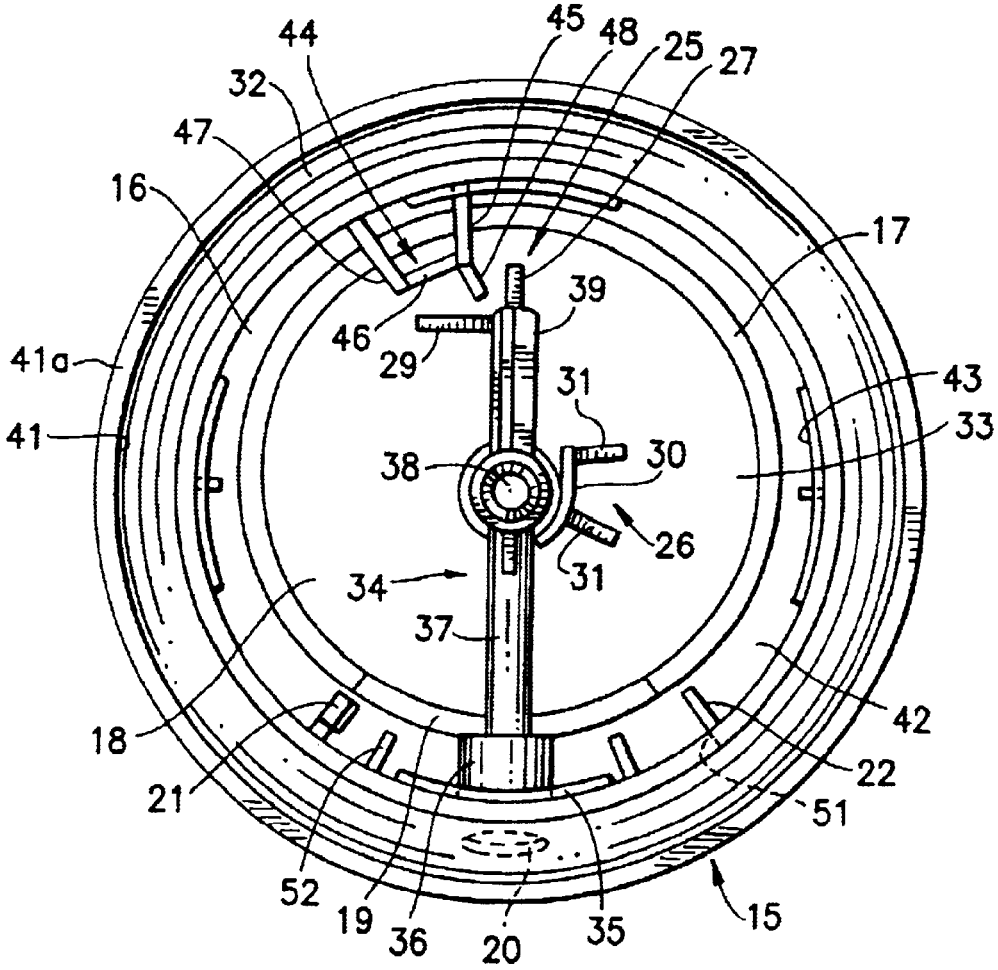
FIG. 4 is a bottom plan view of the assembled aerosol valve actuator of the present invention, with the actuator top portion rotated relative to the actuator bottom portion to a first operative rotated position for valve actuation.
Figure 5:
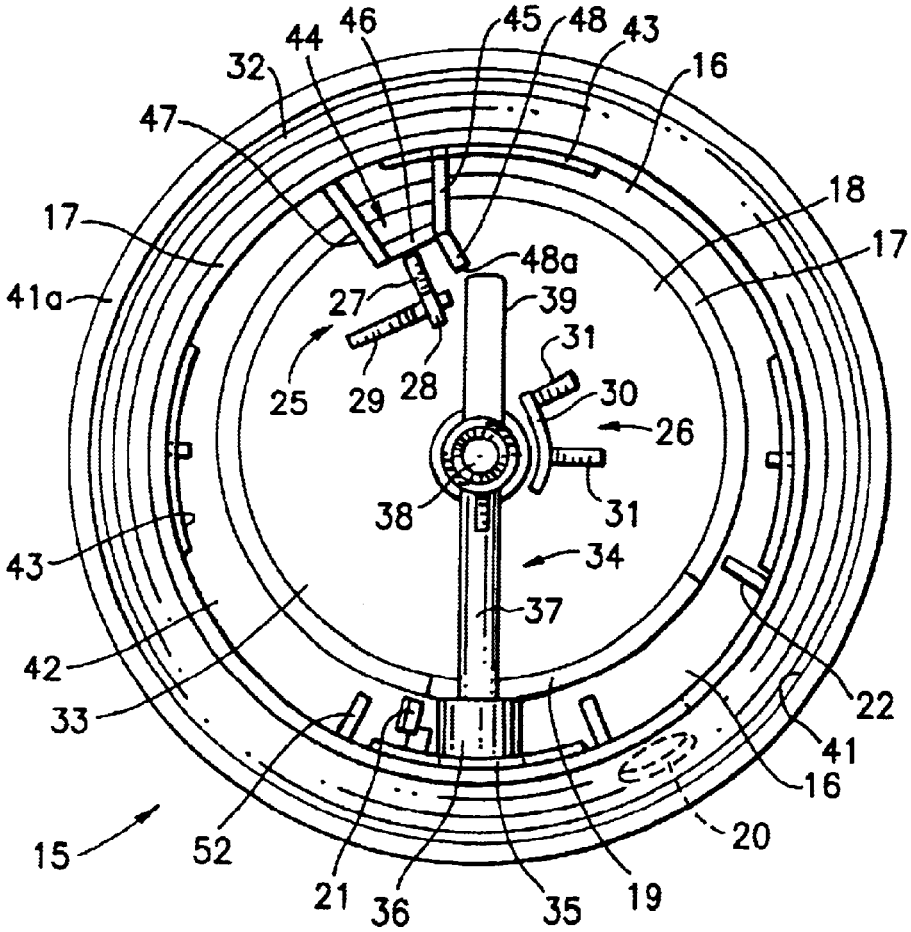
FIG. 5 is a bottom plan view of the assembled aerosol valve actuator of the present invention, with the actuator top portion rotated relative to the actuator bottom portion to a second inoperative rotated position at which the valve cannot be actuated.

Now viewing the underside of top portion 14, as illustrated in FIGS. 3, 4 and 5, abutments 21 and 22 are located on the inner wall of collar 16 and serve as stop means in combination with other means on the bottom portion 15 of the actuator to define both the first operative and second inoperative rotated positions of top portion 14 in relation to bottom portion 15. Also referring to FIG. 3, ledges 23 are shown placed on and around the lower inner wall of collar 16, which ledges snap into annular groove 24 in lower actuator portion 15 when top actuator portion 14 is mounted onto lower actuator portion 15 to assemble the actuator.

FIGS. 3, 4, 5 and 6 also illustrate first protrusion 25 and second protrusion 26 both integrally molded with and extending from the underside of finger pad 18. First protrusion 25 is comprised of a trapezoidal member 27 having a short lower knife edge 28, and a second trapezoidal member 29 serving solely as a structural support for member 27 to consistently and accurately position knife at edge 28. Knife edge 28 in the first operative rotated position of actuator top portion 14 interacts with structure hereinafter described on actuator bottom portion 15 to actuate the aerosol valve. Second protrusion 26 on the underside of finger pad 18 is comprised of arcuate member 30, and triangular members 31 for structurally supporting arcuate member 30. Arcuate member 30 serves to brace against structure on actuator lower portion 15 as hereinafter described when top portion 14 is in the first operative rotated position.

Molded actuator bottom portion 15 as shown in FIGS. 3, 4, 5 and 6 is comprised of second collar 32 having a second central opening 33 and a product channel member 34 pivotally mounted by a living hinge 35 to second collar 32 and extending crosswise within the ambit of said second central opening 33 in plan view. Product channel member 34 has a product dispensing nozzle 36 connected by the living hinge 35 to the top of second collar 32, and an enclosed lateral channel 37 extending from nozzle 36 rearwardly to downwardly extending channel 38 within which fits aerosol valve stem 13 when aerosol actuator 10 is fitted onto the aerosol container. When the aerosol valve is actuated as hereinafter described, product flows from the aerosol container 11 up valve stem 13 into channels 38 and 37 and out nozzle 36. Nozzle 36 is aligned with lateral opening 20 in actuator top portion 14 when the aerosol valve is actuated, so that product from nozzle 36 passes through opening 20 to exit the actuator. When nozzle 36 is not aligned with opening 20, the aerosol valve cannot be actuated.

Product channel member 34 further has a rearward extension 39 with a groove 40 in its top surface within which fits lower knife edge 28 of first protrusion 25 when the actuator top portion 14 is in the first operative rotated position and finger pad 18 is pressed downwardly. Groove 40 is placed off-center on extension 39 so that groove 40 is directly adjacent the lateral edge of the top surface of extension 39 (see FIG. 3). In this first operative rotated position, first protrusion 25 is in the position shown in FIG. 4 so that member 27 with knife edge 28 overlies groove 40 (also see FIG. 6). Second protrusion 26 of finger pad 18 is thus in the position shown in FIG. 4, with the arcuate member 30 braced against the side of the product channel member 34 to prevent lateral movement thereof. It is therefore assured that knife-edge 28 will accurately align with groove 40 each time the actuator is rotated to its operative position. In the second inoperative rotated position shown in FIG. 5, wherein top actuator portion 14 has been rotated in relation to bottom actuator portion 15, first and second protuberances 25 and 26 are in the positions shown, and knife-edge 28 is no longer aligned with groove 40. Groove 40 is placed off-center on extension 39 as noted above so that when top actuator portion 14 is first rotated from the operative toward the inoperative position, knife edge 28 immediately moves from above extension 39 to an out-of-alignment position with extension 39.

Figure 6:
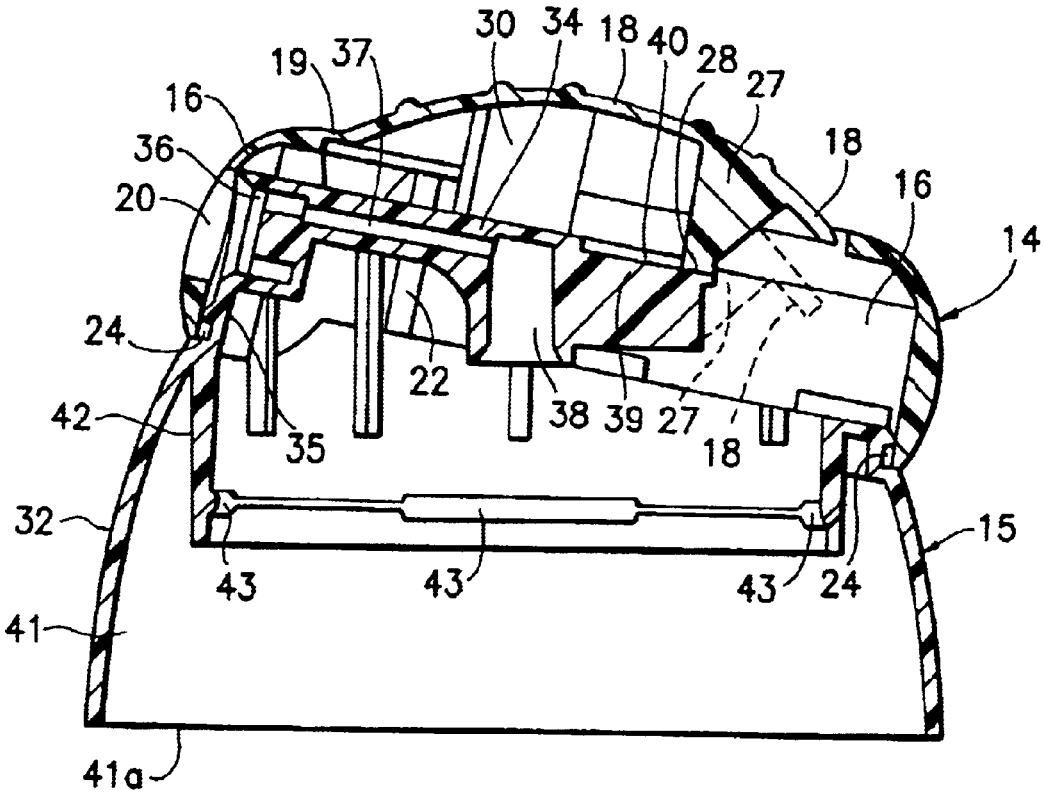
FIG. 6 is an axial cross-sectional view of the assembled aerosol valve actuator of the present invention in the first operative rotated position for valve actuation.

In either the first operative position (FIG. 4) or the second inoperative rotated position (FIG. 5) of the actuator, finger pad 18 may be pushed downwardly. In the FIG. 4 operative position, depression of finger pad 18 operates through knife-edge 28 in groove 40 to pivot product channel member 34 downwardly about its hinge 35 to actuate the aerosol valve and dispense product through nozzle 36 and opening 20. In the FIG. 5 inoperative position, however, depression of finger pad 18 does not actuate the aerosol valve since protrusion 25 with knife-edge 28 is now displaced out of alignment with product channel member 34 and moves downwardly below and bypasses the product channel member 34. FIG. 6 illustrates in dotted lines the resultant position of member 27 of protuberance 25 when finger pad 18 is pressed downwardly in the FIG. 5 inoperative rotated position. As shown in FIG. 5, it also can be seen that nozzle 36 and opening 20 are not aligned in the actuator inoperative rotated position. Nozzle 36 is now blocked by the inner side wall of collar 16.

Further referring to actuator base portion 15 and FIG. 6, second collar 32 is comprised of outer skirt 41, the bottom edge 41*a* of which rests on the top of aerosol container 11, and inner skirt 42 which has inwardly directed ledges 43 to snap under the aerosol valve mounting cup 12.

Second collar 32 additionally has a first upstanding integrally molded support 44 which is comprised of supporting legs 45, 46 and 47 and upward extension 48 as shown in FIGS. 3, 4 and 5. Upward extension 48 is initially connected by a frangible tag 48*a* to the end of rearward extension 39 of product channel member 34. Frangible tag 48*a* serves the function of preventing the product channel member 34 from being displaced upward when the aerosol actuator is mounted on the valve stem before the first intentional actuation of the aerosol valve, the tag 48*a* being broken upon said first actuation. Finger pad 18 also may have a corresponding frangible tag 18*a* connected to first collar 16 of actuator top portion 14, tag 18*a* preventing depression of the finger pad 18 during shrink-wrap packaging of the actuator. Tag 18*a* is broken upon first actuation of finger pad 18 by the consumer. When finger pad 18 is depressed in either the first operative rotated position or the second inoperative rotated position of actuator top portion 14, leg 45 of first upstanding support 44 in both cases provides a lower limit stop for the rear edge of finger pad 18 to abut against and thereby prevent further downward pivotal motion.

Also upwardly extending from second collar 32 is wall 50 as shown in FIG. 3. Wall 50 is separate from and lies directly adjacent to nozzle 36, and when the actuator is in its second inoperative rotated position, opening 20 in actuator top portion 14 faces said wall 50 so that a user can observe that the actuator is not in its operative position even though finger pad 18 can be depressed to the same extent as in the operative position. Edge 51 of wall 50 also serves as a stop for abutment 22 of actuator top portion 14 to swing against (see FIG. 4), thereby defining the first operative rotated position of the actuator wherein nozzle 36 and opening 20 are aligned for product dispensing. When actuator top portion 14 is rotated to its second inoperative rotated position, abutment 21 of actuator top portion 14 is rotated against nozzle 36 (see FIG. 5) which nozzle serves as a stop to define the second inoperative rotated position. Abutment 21 may also have a flexible extension on its lower end which will give an audible clicking sound as it passes over strengthening rib 52 on the interior of second collar 32.

The several features of the present invention described above together define a unique, simple and strong camless aerosol actuator which is easily manufactured and assembled, and which functions reliably and efficiently for the consumer.

It will be appreciated by persons skilled in the art that variations and/or modifications may be made to the present invention without departing from the spirit and scope of the invention. The present embodiment is, therefore, to be considered as illustrative and not restrictive. It should also be understood that positional terms as used in the specification are used and intended in relation to the positioning shown in the drawings, and are not otherwise intended to be restrictive.

What is claimed is:

1. An actuator for an aerosol valve characterized by the absence of a cam and cam follower and comprising in combination: a top portion and a bottom portion, said top portion being mounted on and rotatable in relation to said bottom portion between a first operative rotated position for valve actuation and a second inoperative rotated position at which the valve cannot be actuated; said top portion comprising a first collar defining a first central opening within which extends a finger pad mounted pivotally to the collar, said collar further having a side opening for the dispensing of product; said bottom portion comprising a second collar defining a second central opening and a product channel member pivotally mounted to said second collar and extending across said second central opening; said product channel member having a product dispensing nozzle adjacent said second collar and further having means for connection to the aerosol valve to allow product flow from the valve to the nozzle upon valve actuation; said finger pad on the actuator top portion having a first protrusion extending therefrom which overlies and aligns with the product channel member on the actuator bottom portion in the first operative rotated position of the top portion, said nozzle also aligning with said first collar side opening in the said first operative rotated position; said first protrusion being displaced out of alignment with the product channel member in the second inoperative rotated position of the top portion, said nozzle being out of alignment with said first collar side opening and being blocked by the first collar in the said second rotated position; said finger pad being pivotable downwardly in both the first and second rotated positions of the top portion; said first protrusion, when the finger pad is pushed downward, pivoting the product channel member downwardly to actuate the aerosol valve in the first operative rotated position of the top portion; and, said first protuberance when the finger pad is pushed downward, moving downward below and bypassing the product channel member in the second inoperative rotated position of the top portion so as not to actuate the aerosol valve.

2. The actuator of claim 1, wherein said second collar has a first upstanding support connected to said product channel member by a first frangible tag which ruptures upon the first actuation of the aerosol valve, said first upstanding support further providing a lower limit stop for the finger pad when depressed.

3. The actuator of claim 1, wherein a wall extends upwardly from said second collar adjacent the nozzle to block said first collar side opening while the top portion is in the second inoperative rotated position.

4. The actuator of claim 1, wherein said second collar has ledge means for snapping the second collar onto an aerosol valve mounting cup.

5. The invention of claim 4, wherein said second collar has an outer skirt and an inner skirt, said inner skirt containing said ledge means.

6. The actuation of claim 1, wherein said top and bottom portions have complementary snap means for assembling the top and bottom portions to one another.

7. The invention of claim 1, wherein the top and bottom portions have respective stop means defining both the first and the second rotated positions of the top portion.

8. The invention of claim 1, wherein said finger pad has a second protrusion extending therefrom which braces against the side of the product channel member when the top portion is in the first rotated position.

9. The invention of claim 1, wherein said finger pad is connected to said first collar by a second frangible tag which ruptures upon first actuation of the aerosol valve.

10. The invention of claim 1, wherein said product channel member has a groove in its top surface, and said finger pad first protrusion has a knife-like edge fitting into said groove when the finger pad is pressed downwardly while the top portion is in the first operative rotated position.

11. The invention of claim 10, wherein said groove is placed directly adjacent the lateral edge of the top surface of the product channel member.

12. The invention of claim 1, wherein said nozzle is attached to and extends upwardly from said second collar.

* * * * *